United States Patent [19]

Otsuka et al.

[11] Patent Number: 4,582,037

[45] Date of Patent: Apr. 15, 1986

[54] FUEL SUPPLY ADJUSTING SYSTEM CAPABLE OF QUICKLY RESPONDING TO A COMMANDED ENGINE SPEED

[75] Inventors: Kazuyoshi Otsuka, Tokyo; Takayoshi Nishimori, Hiroshima, both of Japan

[73] Assignees: NEC Corporation; Mazda Motor Corporation, both of Japan

[21] Appl. No.: 669,975

[22] Filed: Nov. 9, 1984

[30] Foreign Application Priority Data

Nov. 11, 1983 [JP] Japan ..... 58-211815

[51] Int. Cl.[4] ..... F02D 5/02

[52] U.S. Cl. ..... 123/492; 123/493

[58] Field of Search ..... 123/492, 493

[56] References Cited

U.S. PATENT DOCUMENTS 4,440,119 4/1984 Kobayashi ..... 123/492
4,528,964 7/1985 Kashiwaya ..... 123/492
4,534,331 8/1985 Belzen ..... 123/492

FOREIGN PATENT DOCUMENTS 55-51679 11/1981 Japan ..... 123/492

*Primary Examiner*—Ronald B. Cox
*Attorney, Agent, or Firm*—Sughrue, Mion, Zinn, Macpeak, and Seas

[57] ABSTRACT

For an internal combustion engine workable at a variable speed, a fuel supply adjusting system makes a fuel supplying device supply fuel to the engine on acceleration thereof. A commanded engine speed is successively detected at a first, a second, and a current instant of time. Judgment is made in response to the commanded engine speeds at the first and the current instants whether or not the engine is being accelerated. A rate of the acceleration is calculated in response to the commanded engine speeds at the second and the current instants. An additional amount of supply of the fuel is decided by the fuel supply adjusting system in response to the rate of the acceleration and to an actual engine speed only when the engine is being accelerated.

7 Claims, 4 Drawing Figures

FUEL SUPPLY ADJUSTING SYSTEM CAPABLE OF QUICKLY RESPONDING TO A COMMANDED ENGINE SPEED

BACKGROUND OF THE INVENTION

This invention relates to a fuel supply adjusting system for an internal combustion engine and a method for use in the fuel supply adjusting system.

Internal combustion engines are widely used in driving vehicles, such as automobiles. An internal combustion engine is workable at a variable speed. Such a speed of the engine is called an engine speed in the art. An operator of the engine can work the engine at a commanded engine speed. This enables the vehicle to be driven by a driver at a desired speed in cooperation with a selected gear ratio.

A fuel supplying device is coupled to the engine. The fuel supplying device may have a controllable fuel injector orifice through which a fuel is injected into the engine. Furthermore, a speed adjusting device is coupled to the engine. The speed adjusting device may comprise a throttle valve which defines a controllable throttle value opening for an air flow to the engine. On accerelating the engine to the commanded engine speed, the operator controls the speed adjusting device to put the device into a varying state of, for example, increasing the air flow. A fuel supply adjusting system is coupled to the fuel supplying and the speed adjusting devices to adjust the fuel supplying device in response to the varying state.

A conventional fuel supply adjusting system is for detecting at first a previous and a current state which the variable state successively takes at a previous and a current instant of time, respectively. Responsive to the previous and the current states, the fuel supply adjusting system detects whether or not the engine is being accerelated. When the accerelation is detected, the fuel supply adjusting system calculates a rate of variation of the varying state in response to the previous and the current states. At the current instant, the fuel supply adjusting system makes the fuel supplying device supply an increased amount of fuel in response to the rate of variation.

The previous instant is a predetermined time interval prior to the current instant. The predetermined time interval should be short in order promptly to make the engine work at the commanded engine speed. Noise is, however, inevitably superposed on the calculated rate of variation. The predetermined time interval must therefor be relatively long. This results in a considerable delay in making the engine attain the commanded engine speed. Moreover, this prevents detailed detection of the accerelation and results in unsuitable operation of the fuel supply adjusting system. The results of the unsuitable operation are, for example, an unnecessary fuel consumption and insufficient operation of an exhaust emission control device which is attached to the engine for purification of exhaust gas.

SUMMARY OF THE INVENTION

It is therefore an object of the present invention to provide a fuel supply adjusting system which is for coupling to an internal combustion engine for use in optimally adjusting a fuel supplying device for the engine.

It is another object of this invention to provide a fuel supply adjusting device of the type described, which is capable of making the engine achieve a commanded speed without an appreciable delay on accerelation of the engine.

It is still another object of this invention to provide a fuel supply adjusting system of the type described, which is capable of reducing an unnecessary fuel consumption.

It is yet another object of this invention to provide a fuel supply adjusting system of the type described, which is capable of making an exhaust emission control device of the engine sufficiently work to purify exhaust gas of the engine.

It is another object of this invention to provide a method for use in a fuel supply adjusting system of the type described, which is capable of accurately responding to a commanded speed on accerelation of the engine.

A fuel supply adjusting system to which this invention is applicable is for use in combination with a fuel supplying device for supplying fuel to an internal combustion engine and with a speed adjusting device which is for coupling to the engine and is put into a varying state on accerelation of the engine. According to this invention, the fuel supply adjusting system comprises state detecting means coupled to the speed adjusting device for detecting a first, a second, and a current state which the varying state successively takes at a first, a second, and a current instant of time, accerelation detecting means coupled to the state detecting means for detecting the accerelation in response to the first and the current states, rate calculating means coupled to the state and the accerelation detecting means for calculating a rate of variation of the varying state in response to the second and the current states when the accerelation is detected by the accerelation detecting means, and adjusting means responsive to the rate of variation for adjusting the fuel supplying device at the current instant.

DESCRIPTION OF THE PREFERRED EMBODIMENTS

Figure 1:
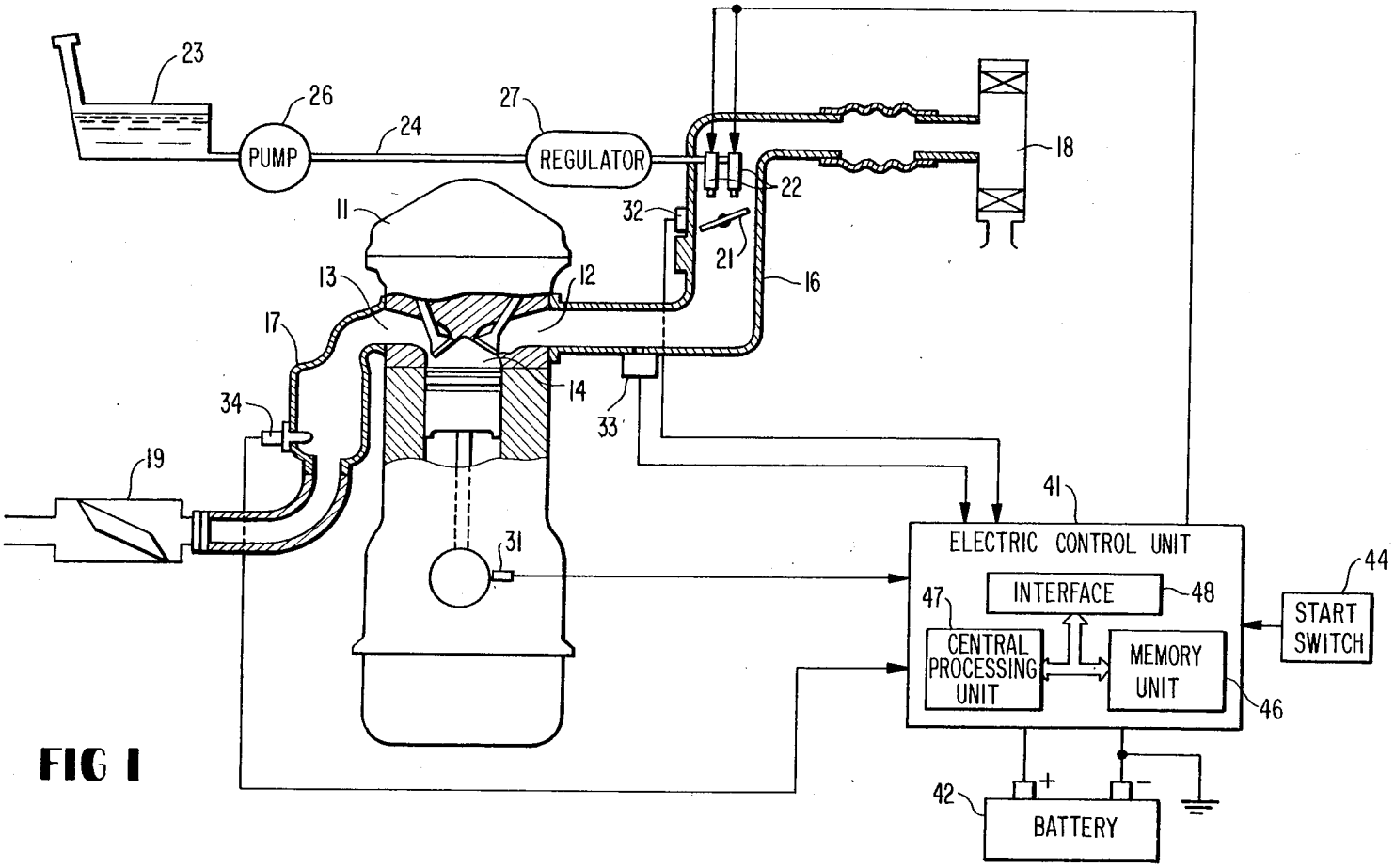
FIG. 1 shows a block diagram of a fuel supplying adjusting system according to a preferred embodiment of this invention together with an internal combustion engine and a fuel supplying device.

Referring to FIG. 1, an engine system comprises an internal combustion engine 11 which is typically a reciprocating engine. A fuel supply adjusting system according to a preferred embodiment of this invention is used in combination with the engine system. The engine system may be for use in an automobile. The engine 11 has an inlet port 12 and an exhaust port 13 which are in communication with a combustion chamber 14 of the engine 11. A suction pipe 16 and an exhaust pipe 17 are connected to the inlet port 12 and the exhaust port 13, respectively. The engine 11 is workable at a variable engine speed. An air cleaner 18 is connected to an inlet end of the suction pipe 16 to clean the air which will be sucked into the combustion chamber 14. A purifying member or exhaust emission control device 19 is connected to an outlet end of the exhaust pipe 17 to purify an exhaust gas which is exhausted from the combustion chamber 14.

The suction pipe 16 is provided with a throttle valve 21 inside thereof. The throttle valve 21 is swingable and is operated by an accerelator member (not shown), such as an accerelation pedal, from outside of the suction pipe 16. The accerelator member may be operated on accerelation of the engine 11 by an operator of the engine system or by a driver of the automobile to adjust an area of the opening of the throttle valve 21 and to control the engine speed. Thus, the throttle valve 21 defines a controllable opening. The engine speed is selected by the operator or the driver and will be referred to as a commanded engine speed. The throttle valve 21 is put into a varying state on accerelation of the engine 11 to work the engine 11 at the commanded engine speed.

A fuel injector assembly 22 is connected to the suction pipe 16 to selectively inject fuel into the suction pipe 16. The fuel is injected from a position predetermined between the throttle valve 21 and the inlet end of the suction pipe 16. The fuel injector assembly 22 is connected to a fuel tank 23 through a fuel pipe 24. The fuel tank 23 is for storing the fuel therein. The fuel is forced by a fuel pump 26 from the fuel tank 23 to the fuel injector assembly 22 through the fuel pipe 24 and a fuel pressure regulator 27. Thus, a combination of the fuel injector assembly 22, the fuel tank 23, the fuel pipe 24, the pump 26, and the fuel pressure regulator 27 is operable to supply the fuel to the engine 11 and may therefore be called a fuel supplying device.

The fuel injector assembly 22 may comprise a pair of the electromechanical poppet valves having injector orifices designed to inject the fuel within the suction pipe 16 at a predetermined pressure.

The engine 11 is provided with a crank position sensor or an engine speed sensor 31 for successively sensing an actual engine speed to produce a succession of first signals representative of the actual engine speed. It is mentioned here that the actual engine speed is varied with a delay relative to the commanded engine speed. A throttle position sensor 32 is attached to an outer surface of the suction pipe 16. The throttle position sensor 32 is opposite to the throttle valve 21 and is for sensing the opening area to produce a succession of second signals representative of the commanded engine speed indicated by the driver. A pressure sensor 33 is attached to the engine 11 adjacently of the inlet port 12. The pressure sensor 33 is for sensing an internal pressure of the suction pipe 16 to produce a succession of third signals representative of the internal pressure. An exhaust gas sensor 34 is attached to the exhaust pipe 17 to sense concentration of oxygen included in the exhaust gas to produce a succession of fourth signals representative of the oxygen concentration of the exhaust gas.

In FIG. 1, the engine system comprises an electric control unit 41 coupled to the above-mentioned sensors 31 through 34 and also to the fuel injector assembly 22 in the manner which will be described in the following. The illustrated electric control unit 41 is energized by a battery 42 and starts a control operation when a start switch 44 is operated. The control operation is for controlling supply of the fuel and the air to the engine 11. For this purpose, the electric control unit 41 controls the fuel injector assembly 22 in response to the first through the fourth signal successions during the control operation.

In order to carry out the control operation, the electric control unit 41 comprises a memory unit 46, a central processing unit 47, and an interface 48 which is coupled to the central processing unit 47 and the memory unit 46 and also the sensors 31 through 34.

Figure 2:
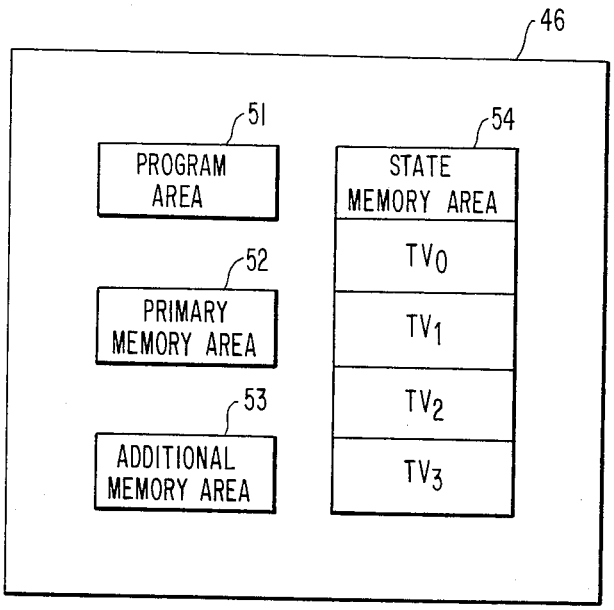
FIG. 2 shows a view for use in describing a memory unit of the fuel supply adjusting system illustrated in FIG. 1.

Referring to FIG. 2 together with FIG. 1, the control operation is divided into a primary mode and an additional mode of operation. The primary mode is for deciding a fundamental amount of supply of the fuel. In the primary mode, the first signal succession which is given from the engine speed sensor 31 is processed by the central processing unit 47 in accordance with a primary program stored in a program area 51 (FIG. 2) of the memory unit 46. The primary program accesses a primary data table stored in a primary memory area 52 of the memory unit 46 and delivers a main pulse corresponding to the fundamental amount to the fuel injection assembly 22. The main pulse has a pulse width dependent on the first signal succession. The primary memory area 52 may be called a first data area. The third and the fourth signal successions may be used to decide the fundamental amount of supply of the fuel together with the first signal succession. Anyway, the fuel injector assembly 22 is operated in response to the main pulse.

The additional mode of operation is for adjusting an additional amount of supply of the fuel on accerelation of the engine 11 to compensate for the primary mode of operation. In the additional mode, an additional program is read out of the program memory 51 and executed to process the second signal succession by the central processing unit 47 with reference to an additional data table stored in an additional memory area 53 (FIG. 2). The additional memory area 53 may be called a second data area. The first signal succession may be used together with the second signal succession. At any rate, an additional pulse is delivered from the additional memory area 53 to the fuel injector assembly 22 in accordance with the additional data table in the manner which will presently be described.

As will readily be understood from the above, the electric control unit 41 serves to adjust the additional amount of supply of the fuel in the additional mode in combination with the fuel injector assembly 22 and the fuel supplying device (23, 24, 26, and 27) and may therefore be referred to as the fuel supply adjusting system when the electric control unit 41 is operated in the additional mode.

In the manner already described before, the second signal succession is sent from the throttle position sensor 32 to the memory unit 46 through the interface 48 and is indicative of the commanded speeds successively indicated by the throttle valve 21. In other words, each of the second signals is indicative of the opening rate of the throttle valve 21 which is variable with time. The controllable opening of the throttle valve 21 may be called a varying state.

Let the varying state be detected at a predetermined period $T_s$ of, for example, 10 milliseconds or so at a current time instant and a plurality of previous time instants preceding the current time instant. In the example being illustrated, the additional amount of supply of the fuel is calculated in the additional mode by the use of three previous states and a current state which the varying state takes at three of the previous time instants and the current time instant, respectively. The three previous time instants may be called an oldest, an older, and an old time instant, respectively. In this connection, the three previous states which take at the oldest, the older, and the old time instants may be referred to as an oldest, an older, and an old state, respectively. As will become clear as the description proceeds, the older previous state is not used in the calculation of the additional amount of supply of the fuel. Accordingly, the oldest and the old previous states will be named a first and a second state, respectively, while the oldest and the old previous time instants, a first and a second time instant, respectively.

In the additional mode, the current through the oldest states are at first detected by the central processing unit 47 in accordance with the additional program read out of the program area 51. Therefore, the central processing unit 41 is operable as a state detecting circuit when the additional program read out of the program area 51 processes the second signal succession.

The memory unit 46 comprises a state memory area 54 for storing the second signals like a shift register. More specifically, the state memory area 54 is divided into zeroth through third sections $TV_0$, $TV_1$, $TV_2$, and $TV_3$ for storing the current, the old, the older, and the oldest states in the form of the second signals, respectively. This means that each state or second signal is successively shifted from the zeroth section $TV_0$ towards the third section $TV_3$.

Figure 4:
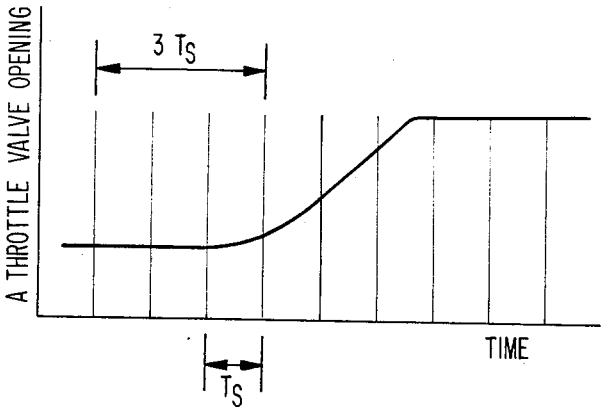
FIG. 4 shows a time chart for use in describing operation of the internal combustion engine illustrated in FIG. 1.
Figure 3:
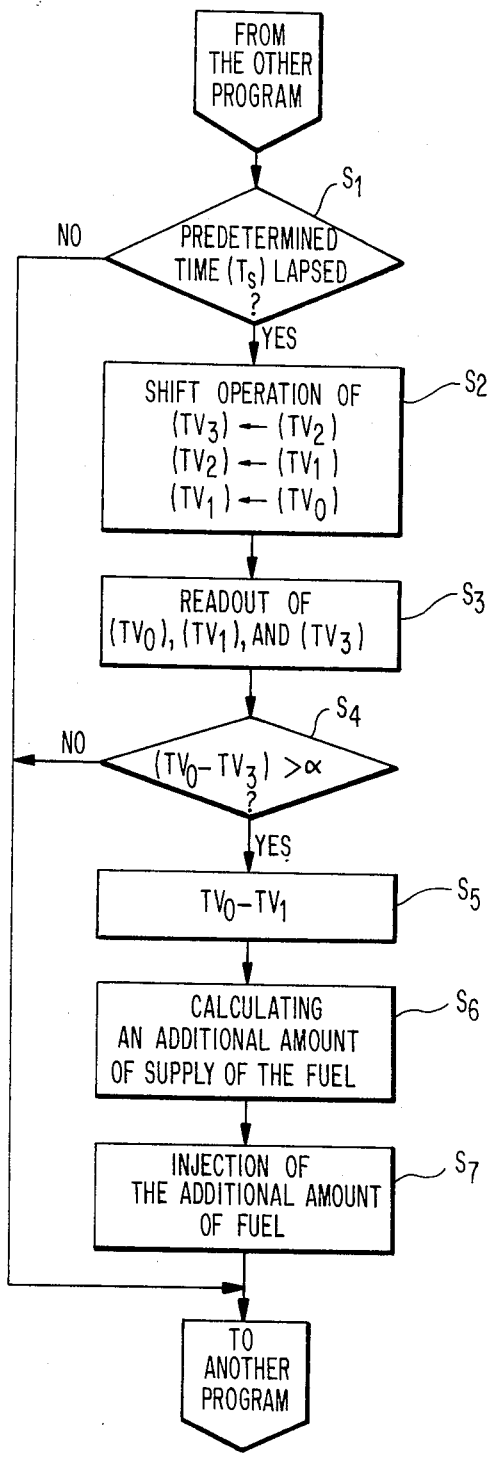
FIG. 3 shows a flow chart for use in describing operation of the fuel supply adjusting system illustrated in FIG. 1.

Referring to FIGS. 3 and 4 together with FIGS. 1 and 2, operation of the central processing unit 47 will be described more in detail. The operation is started and enters a first stage $S_1$ for monitoring a preselected interval of time equal to the predetermined period $T_s$. When the preselected interval of time does not lapse, the first stage $S_1$ proceeds to another program through the last stage shown at the bottom of FIG. 3. Otherwise, the first stage $S_1$ is followed by a second stage $S_2$ at which each of the second signals is successively shifted in the state memory area 54 from the zeroth section $TV_0$ towards the third section $TV_3$. As a result, the varying state stored in the zeroth section $TV_0$ is shifted to the first section $TV_1$. Similarly, the varying states stored in the first and the second sections $TV_1$ and $TV_2$ are shifted to the second and the third sections $TV_2$ and $TV_3$, respectively. The varying state formerly stored in the third section $TV_3$ is erased from the memory unit 46. The current, the old, the older, and the oldest states are stored in the zeroth through the third sections $TV_0$ to $TV_3$ in the above-mentioned manner, respectively, and are depicted at ($TV_0$), ($TV_1$), ($TV_2$), and ($TV_3$), respectively. As mentioned before, the second signals correspond to the opening area of the throttle valve 21 and are therefore representative of the commanded engine speeds detected at the current, the old, the older, and the oldest time instants. Accordingly, the current through the oldest states will be called a current, an old, an older, and an oldest one of the commanded engine speeds, respectively.

At a third stage $S_3$, the current state ($TV_0$), the old state ($TV_1$), and the oldest state ($TV_3$) are read out of the zeroth, the first, and the third sections $TV_0$, $TV_1$, and $TV_3$, respectively, under control of the central processing unit 47 and are moved to a register section (not shown) of the central processing unit 47.

Under the circumstances, the current and the oldest states ($TV_0$) and ($TV_3$) are derived from the register section at a fourth stage $S_4$ in accordance with the additional program to detect accerelation of the engine. Specifically, the oldest state, namely, the oldest commanded engine speed is subtracted from the current state, namely, the current engine speed to calculate a difference between the current and the oldest commanded engine speeds. The difference is compared with a predetermined value $\alpha$. When the difference is greater than the predetermined value $\alpha$, the central processing unit 47 detects the accerelation of the engine 11 and makes the fourth stage $S_4$ proceed to a fifth stage $S_5$. Otherwise, the fourth stage $S_4$ is followed by the other program. Thus, the central processing unit 47 may be called an accerelation detection circuit when operation is carried out at the fourth stage $S_4$. Anyway, the accerelation detection circuit is operatively coupled to the memory unit 46 because the current and the oldest states are accessed at the fourth stage $S_4$. The oldest state may be referred to as the first state or first engine speed.

At the fifth stage $S_5$, a rate of accerelation is calculated in response to the current and the old states ($TV_0$) and ($TV_1$) derived from the zeroth and the first sections $TV_0$ and $TV_1$, respectively. For this purpose, the central processing unit 47 subtracts the old state ($TV_1$) from the current state ($TV_0$) during the fifth stage $S_5$. The central processing unit 47 serves as a rate calculation circuit for calculating a rate of variation between the current and the old states ($TV_0$) and ($TV_1$).

At a sixth stage $S_6$, the central processing unit 47 calculates the additional amount of supply of the fuel with reference to the rate of variation calculated at the fifth stage $S_5$. In this event, the actual engine speed which is specified by the first signal succession may be used together with the rate of variation.

In the example being illustrated, the central processing unit 47 accesses the additional data table in response to the actual engine speed and the rate of variation and produces the additional pulse representative of the additional amount determined by the rate of variation and the actual engine speed. A pulse width of the additional pulse is controlled in compliance with the date of variation and the actual engine speed.

The additional pulse is delivered from the central processing unit 47 to the fuel injector assembly 22. As a result, the additional amount of fuel which is indicated by the additional pulse is injected into the engine 11 through the throttle valve 21, as shown at a seventh stage $S_7$. The injection of the additional amount of fuel is asynchronous with a revolution of the engine 11 and may therefore be named asynchronous injection of fuel. The additional mode of operation is completed after the asynchronous injection of fuel.

Thus, the sixth and the seventh stages $S_6$ and $S_7$ serve to adjust the fuel supplying device at the current instant of time. Therefore, the central processing unit 47 may be referred to as a fuel adjusting circuit.

In the above description, operation carried out at the sixth and the seventh stages $S_6$ and $S_7$ is for controlling the additional amount of supply of the fuel and may be called an additional adjusting control operation. The additional adjusting operation is carried out when execution of the control operation is decided at the fourth stage $S_4$. Therefore, the central processing unit 47 serves to decide execution or nonexecution of the additional adjusting operation at the fourth stage $S_4$. Under the circumstances, the central processing unit 47 is operable as a first circuit for deciding execution or nonexecution of the control operation at the fourth stage $S_4$ and as a second circuit for executing the additional adjusting operation at the sixth and the seventh stages $S_6$ and $S_7$.

As shown in FIG. 4, judgement is made whether or not the engine is being accerelated during a short time interval $T_s$ in the fuel supply adjusting system. In addition, the rate of the accerelation is calculated in response to the varying state of the throttle valve 1 during a somewhat longer time interval $3T_s$. Therefore, the fuel supply adjusting system is capable of making the engine 11 achieve the commanded engine speed without an appreciable delay on accerelation of the engine 11. This results in an improvement of fuel consumption and purification of the exhaust gas.

While this invention has thus far been described in conjunction with a specific embodiment thereof, it will readily be possible for those skilled in the art to put this invention into practice in various other manners. For example, the fuel injection assembly 22 may be connected to a position between the throttle valve 21 and the inlet port 12. A carburetor may be used in place of the fuel injection assembly 22. The rate of accerelation may be calculated between the current and the older states, namely, between the current and the older commanded engine speeds. The varying state may be derived in the form of a pressure from an intake manifold operatively coupled to the throttle valve 21.

What is claimed is:

1. A fuel supply adjusting system for use in combination with a fuel supplying device for supplying fuel to an internal combustion engine and with a speed adjusting device which is for coupling to said engine and is put into a varying state on accerelation of said engine, said fuel supply adjusting system comprising:

state detecting means coupled to said speed adjusting device for detecting a first, a second, and a current state which said varying state successively takes at a first, a second, and a current instant of time;

accerelation detecting means coupled to said state detecting means for detecting said accerelation in response to said first and said current states;

rate calculating means coupled to said state and said accerelation detecting means for calculating a rate of variation of said varying state in response to said second and said current states when said accerelation is detected by said accerelation detecting means; and adjusting means responsive to said rate of variation for adjusting said fuel supplying device at said current instant.

2. A fuel supply adjusting system as claimed in claim 1, said speed adjusting device comprising a throttle valve defining a controllable opening, wherein said state detecting means is for sensing said controllable opening.

3. A fuel supply adjusting system as claimed in claim 1, wherein said fuel supplying device comprises a fuel injector assembly for injecting said fuel into said engine, said adjusting means being for adjusting said fuel injector assembly.

4. A fuel supply adjusting system as claimed in claim 1, said engine being workable at a variable speed, said fuel supply adjusting system further comprising engine speed detecting means coupled to said engine for detecting a current speed of said variable speed, wherein said adjusting means is responsive to said rate of variation and said current speed for adjusting said fuel supplying device at said current instant.

5. A fuel supply adjusting system as claimed in claim 4, wherein:

said state detecting means comprises means coupled to said speed adjusting device for detecting said first, said second, and said current states and state memory means for storing said first, said second, and said current states at said first, said second, and said current instants, respectively;

said accerelation detecting and said rate calculating means being coupled to said state memory means to detect said accerelation and to calculate said rate of variation, respectively;

said adjusting means comprising:

first data memory means for memorizing a main data table for use in accordance with said current speed in deciding a fundamental amount of supply of said fuel through said fuel supplying device;

second data memory means for memorizing an additional data table for use in compliance with said rate of variation for deciding an additional amount of supply of said fuel through said fuel supplying device; and means coupled to said first and said second data memory means, said rate calculating means, and said engine speed detecting means for supplying said fundamental amount of fuel in accordance with said current speed and for adjusting said fundamental amount by said additional amount in compliance with said rate of variation.

6. A fuel supply adjusting system operable in cooperation with an engine operable at varying states, with a fuel supplying device for supplying fuel to said engine, and with a state detection unit for successively detecting said varying states, said fuel supply adjusting system being responsive to a first, a second, and a current one of said varying states that are successively detected at a first, a second, and a current instant of time, respectively, and being for carrying out an adjusting operation of adjusting the fuel supplied by said fuel supplying device to said engine, said fuel supply control system comprising:

first means coupled to said state detection unit and responsive to said first and said current states for deciding execution or nonexecution of said control operation; and second means coupled to said engine, said fuel supplying device, and said state detection unit and responsive to said second and said current states for executing said control operation when execution of said adjusting operation is decided by said first means.

7. A method of adjusting supply of fuel to an engine from a fuel supplying device in cooperation with a speed adjusting device put into a varying state on accerelation of said engine, said method comprising the steps of:

sensing said varying state;

detecting a first, a second, and a current state which said varying state successively takes at a first, a second, and a current instant of time, respectively;

detecting said accerelation in response to said first and said current states;

calculating a rate of variation of said varying state in response to said second and said current states when said accerelation is detected; and adjusting said fuel supplying device at said current instant.

* * * * *